US009765486B1

(12) United States Patent
Robinson

(10) Patent No.: US 9,765,486 B1
(45) Date of Patent: Sep. 19, 2017

(54) EXPANSION JOINT SEAL FOR SURFACE CONTACT APPLICATIONS

(71) Applicant: Schul International Company, LLC, Pelham, NH (US)

(72) Inventor: Steven R. Robinson, Windham, NH (US)

(73) Assignee: Schul International Company, LLC, Pelham, NH (US)

( * ) Notice: Subject to any disclaimer, the term of this patent is extended or adjusted under 35 U.S.C. 154(b) by 28 days.

(21) Appl. No.: 15/062,354

(22) Filed: Mar. 7, 2016

(51) Int. Cl.
*E04B 1/68* (2006.01)
*E01C 11/12* (2006.01)
*E01C 11/10* (2006.01)

(52) U.S. Cl.
CPC ..... *E01C 11/126* (2013.01); *E01C 11/106* (2013.01); *E04B 1/6801* (2013.01); *E04B 1/6804* (2013.01); *E04B 1/6812* (2013.01)

(58) Field of Classification Search
CPC ..... E04B 1/946; E04B 1/948; E04B 1/6801; E04B 1/6804; E04B 1/6812; F16J 15/10; F16J 15/102; F16J 15/104; F16J 15/12; F16J 15/121; F16J 15/127; F16J 15/128; B32B 5/18; B32B 2260/04
See application file for complete search history.

(56) References Cited

U.S. PATENT DOCUMENTS

| | | | |
|---|---|---|---|
| 945,914 | A | 4/1909 | Colwell |
| 1,371,727 | A | 3/1921 | Blickle |
| 2,544,532 | A | 3/1951 | Hill |
| 2,995,056 | A | 10/1960 | Knox |
| 3,262,894 | A | 7/1966 | Green |
| 3,334,557 | A | 8/1967 | Fitzgibbon |
| 3,449,879 | A | 6/1969 | Bloom |
| 3,492,250 | A | 1/1970 | Deyrup |
| 3,712,188 | A | 1/1973 | Worson |
| 3,772,220 | A | 11/1973 | Porter et al. |
| 3,827,204 | A | 8/1974 | Walters |
| 3,883,475 | A | 5/1975 | Racky et al. |
| 4,018,539 | A | 4/1977 | Puccio |
| 4,058,947 | A | 11/1977 | Earle et al. |
| 4,134,875 | A | 1/1979 | Tapia |
| 4,181,711 | A | 1/1980 | Ohashi et al. |

(Continued)

FOREIGN PATENT DOCUMENTS

| | | |
|---|---|---|
| CA | 1280007 | 2/1991 |
| CA | 1334268 | 2/1995 |

(Continued)

OTHER PUBLICATIONS

Iso Chemie GmbH; Iso-Flame Kombi F120; Jul. 1 2006; 2 pages.

(Continued)

*Primary Examiner* — Gilbert Lee
(74) *Attorney, Agent, or Firm* — Crain, Caton & James, P.C.; James E. Hudson, III

(57) ABSTRACT

A system for creating a durable seal between adjacent horizontal panels, including those that may be curved or subject to temperate expansion and contraction or mechanical shear. The durable seal incorporates a plurality of ribs, a flexible member between the cover plate and the ribs, and may incorporate a load transfer plate to provide support to the rib from below, and/or foams of differing compressibilities.

20 Claims, 5 Drawing Sheets

(56) References Cited

U.S. PATENT DOCUMENTS

| | | | | |
|---|---|---|---|---|
| 4,224,374 | A | 9/1980 | Priest | |
| 4,288,559 | A | 9/1981 | Illger | |
| 4,401,716 | A | 8/1983 | Tschudin-Mahrer | |
| 4,455,396 | A | 6/1984 | Al-Tabaqchall et al. | |
| 4,564,550 | A | 1/1986 | Tschudin-Mahrer | |
| 4,566,242 | A | 1/1986 | Dunsworth | |
| 4,674,252 | A * | 6/1987 | Nicholas | E04B 1/6804 404/69 |
| 4,767,655 | A | 8/1988 | Tschudin-Mahrer | |
| 4,784,516 | A | 11/1988 | Cox | |
| 4,839,223 | A | 6/1989 | Tschudin-Mahrer | |
| 4,922,676 | A | 5/1990 | Spronken | |
| 4,992,481 | A | 2/1991 | von Bonin et al. | |
| 5,007,765 | A | 4/1991 | Dietlein et al. | |
| 5,048,249 | A | 9/1991 | Shreiner | |
| 5,130,176 | A | 7/1992 | Baerveldt | |
| 5,173,515 | A | 12/1992 | von Bonin | |
| 5,253,459 | A | 10/1993 | Parinas et al. | |
| 5,327,693 | A | 7/1994 | Schmid | |
| 5,335,466 | A | 8/1994 | Langohr | |
| 5,575,126 | A * | 11/1996 | Attaway | E04B 1/6804 404/48 |
| 5,686,174 | A | 11/1997 | Irrgeher | |
| 5,744,199 | A | 4/1998 | Joffre et al. | |
| 5,791,111 | A * | 8/1998 | Beenders | E04B 1/6804 404/67 |
| 5,935,695 | A | 8/1999 | Baerveldt | |
| 6,039,503 | A | 3/2000 | Cathey | |
| 6,418,688 | B1 | 7/2002 | Jones, Jr. | |
| 6,491,468 | B1 | 12/2002 | Hagen | |
| 6,666,618 | B1 | 12/2003 | Anaya et al. | |
| 6,698,146 | B2 | 3/2004 | Morgan et al. | |
| 6,928,777 | B2 | 8/2005 | Cordts | |
| 8,317,444 | B1 | 11/2012 | Hensley | |
| 8,341,908 | B1 | 1/2013 | Hensley et al. | |
| 8,365,495 | B1 | 2/2013 | Witherspoon | |
| 8,720,138 | B2 | 5/2014 | Hilburn, Jr. | |
| 8,739,495 | B1 | 6/2014 | Witherspoon | |
| 8,813,449 | B1 | 8/2014 | Hensley et al. | |
| 8,813,450 | B1 | 8/2014 | Hensley et al. | |
| 8,870,506 | B2 | 10/2014 | Hensley et al. | |
| 8,935,897 | B2 | 1/2015 | Shaw | |
| 9,068,297 | B2 | 6/2015 | Hensley et al. | |
| 9,200,437 | B1 | 12/2015 | Hensley et al. | |
| 9,206,596 | B1 | 12/2015 | Robinson | |
| 9,404,581 | B1 * | 8/2016 | Robinson | F16J 15/104 |
| 9,677,266 | B2 | 6/2017 | Witherspoon et al. | |
| 9,689,157 | B1 | 6/2017 | Hensley | |
| 9,689,158 | B1 | 6/2017 | Hensley | |
| 2003/0005657 | A1 | 1/2003 | Visser et al. | |
| 2004/0035075 | A1 | 2/2004 | Trout | |
| 2004/0093815 | A1 | 5/2004 | Cordts | |
| 2005/0034389 | A1 | 2/2005 | Boot | |
| 2006/0053710 | A1 | 3/2006 | Miller et al. | |
| 2006/0117692 | A1 | 6/2006 | Trout | |
| 2007/0059516 | A1 | 3/2007 | Vincent et al. | |
| 2008/0172967 | A1 | 7/2008 | Hilburn | |
| 2008/0268231 | A1 | 10/2008 | Deib | |
| 2010/0275539 | A1 | 11/2010 | Shaw | |
| 2012/0022176 | A1 | 1/2012 | Stahl et al. | |
| 2012/0117900 | A1 | 5/2012 | Shaw | |
| 2013/0055667 | A1 | 3/2013 | Beele | |
| 2013/0104483 | A1 | 5/2013 | Hensley et al. | |
| 2014/0219719 | A1 | 8/2014 | Hensley et al. | |
| 2014/0360118 | A1 | 12/2014 | Hensley et al. | |
| 2015/0023755 | A1 | 1/2015 | Hensley et al. | |
| 2015/0068139 | A1 | 3/2015 | Witherspoon | |
| 2015/0259905 | A9 | 9/2015 | Hensley et al. | |
| 2015/0275508 | A1 | 10/2015 | Hensley et al. | |
| 2016/0047242 | A1 | 2/2016 | Hensley et al. | |

FOREIGN PATENT DOCUMENTS

| | | | |
|---|---|---|---|
| CA | 2296779 | | 11/2006 |
| DE | 4426280 | A1 | 4/1996 |
| DE | 10 2005 054 375 | A1 | 5/2007 |
| EP | 3942107 | A2 | 9/1999 |
| EP | 1540220 | | 3/2006 |
| EP | 1983119 | A1 | 4/2007 |
| GB | 977929 | | 12/1964 |
| GB | 1359734 | | 7/1974 |
| GB | 1495721 | | 12/1977 |
| GB | 1519795 | | 8/1978 |
| GB | 2251623 | A1 | 7/1992 |
| GB | 2359265 | A | 8/2001 |
| WO | 03/006109 | | 1/2003 |

OTHER PUBLICATIONS

IsoChemie; Technical Datasheet blocostop F-120; Jul. 26 2002; 1 page.

Lester Hensley; Where's the Beef in Joint Sealants? Hybrids Hold the Key; Spring 2001; Applicator vol. 23 No. 2; 5 pages (alternative version available at http://www.emseal.com/InTheNews/2001HybridsConstructionCanada.pdf).

MM Systems; ejp Expansion Joints EIF; Nov. 16 2007; 2 pages.

MM Systems; ejp Expansion Joints; Nov. 16, 2007; 2 pages.

MM Systems; MM ColorJoint/SIF Series; 3 pages; Jan. 14, 2007.

Norton Performance Plastics Corporation; Norseal V740FR; 1996; 2 pages.

PCT/US2005/036849 filed Oct. 4 2005 by Emseal Corporation; 11 pages; published Mar. 1, 2007 by World Intellectual Property Organization as WO 2007/024246.

Promat; Promaseal FyreStrip Seals for Movement in Joints in Floors/Walls; Feb. 2006; 4 pages.

Promat; Promaseal Guide for linear gap seals and tire stopping systems; 20 pages; Jun. 2008.

Promat; Promaseal IBS Foam Strip Penetration Seals on Floors/Walls; Sep. 2004; 6 pages.

Promat; Promaseal IBS Safety Data Sheet; Jul. 25, 2007; 3 pages.

Salamander Industrial Products Inc.; Blocoband HF; Feb. 15, 1996; 1 page.

Schul International Co. LLC; Color Econoseal Technical Data; Nov. 18, 2005; 2 pages.

Schul International Co. LLC; Sealtite "B" Technical Data; Oct. 28, 2005; 2 pages.

Schul International Co. LLC; Sealtite Airstop AR; Apr. 2004; 1 page.

Schul International Co. LLC; Sealtite Airstop AR; Apr. 2007; 1 page.

Schul International Co. LLC; Sealtite Standard; May 9, 2007; 2 pages.

Schul International Co. LLC; Sealtite Technical Data; Oct. 28, 2005; 2 pages.

Schul International Co. LLC; Sealtite VP (600) Technical Data; 2002; 2 pages.

Schul International Co. LLC; Seismic Sealtite II Technical Data; Sep. 20, 2006; 2 pages.

Schul International Co. LLC; Seismic Sealtite Technical Data; Oct. 28, 2005; 2 pages.

Lee W. Young, Written Opinion of the International Searching Authority, PCT/US06/60096, dated Oct. 23, 2007, 4 pages, USPTO, USA.

Schul International Inc.; Sealtite 50N Technical Data; 2002; 2 pages.

Schul International Inc.; Sealtite 50N Technical Data; Oct. 28, 2005; 2 pages.

Schul International Inc.; Sealtite 50N; Oct. 28 2005; 2 pages.

Schul International Inc.; Sealtite VP; Oct. 28, 2005; 2 pages.

Schul International Inc.; Sealtite; Jul. 25, 2008; 3 pages.

Sealant Waterproofing & Restoration Institute; Sealants: The Professionals' Guide p. 26; 1995; 3 pages.

Stein et al. "Chlorinated Paraffins as Effective Low Cost Flame Retardants for Polyethylene" Dover Chemical Company 9 pages.

(56) References Cited

OTHER PUBLICATIONS

Tremco illbruck B.V.; Cocoband 6069; Apr. 2007; 2 pages.
Tremco illbruck Limited; Alfacryl FT Intumescent Acrylic; Oct. 22, 2007; 2 pages.
Tremco illbruck Limited; Alfasil FR Oct. 22, 2007; 2 pages.
Tremco illbruck Limited; Compriband 600; Oct. 5, 2007; 2 pages.
Tremco illbruck Limited; Compriband Super FR; Dec. 4, 2007; 2 pages.
Tremco illbruck Limited; Technical Data Sheet Product Compriband Super FR; Oct. 18, 2004; 4 pages.
Tremco Illbruck Limited; Technical Data Sheet Product: Compriband Super; Sep. 29, 2004; 3 pages.
Tremco illbruck Limited; TechSpec Division Façade & Roofing Solutions; Mar. 2005; 10 pages.
Tremco illbruck; Alfas Bond; Apr. 13, 2007; 2 pages.
Tremco Illbruck; illmod 600; Jun. 2006; 2 pages.
Tremco illbruck; The Specification Product Range; Feb. 2007; 36 pages.
Tremco-illbruck Ltd.; Webbflex B1 PU Foam; Nov. 9, 2006; 2 pages.
Thomas Dunn, International Preliminary Report on Patentability—PCT/US06/60096, dated Oct. 21, 2008, 6 pages, USPTO, USA.
Underwriter Laboratories Inc.; UL 2079 Tests for Fire Resistance of Building Joint Systems; Jun. 30, 2008; 38 pages.
Underwriter Laboratories LLC; System No. WW-S-0007 Joint Systems; Dec. 5, 1997 pages.
Underwriters Laboratories; Fire-resistance ratings ANSI/UL 263; 2014; 24 pages.
Underwriters Laboratories; UL 263 Fire Tests of Building Construction and Materials; Apr. 4, 2003; 40 pages.
Lee W. Young, International Search Report, PCT/US06/60096, Oct. 23, 2007, 2 pages, USPTO, USA.
Stein et al. "Chlorinated Paraffins as Effective Low Cost Flame Retardants for Polyethylene" Dover Chemical Company 9 pages, Aug. 3, 2013.
Adolf Wurth GmbH & Co. KG; 81 Elastic Joint Sealing Tape; retrieved Aug. 5, 2005; 4 pages.
Amber Composites; Expanding PU Foam Technical Data Sheet (Premier BG1); Feb. 1997; 2 pages.
ASTM International; ASTM E84-04; 2004; 19 pages.
ASTM International; Designation E 176 -07 Standard Terminology of Fire Standards; 2007; 20 pages.
ASTM International; Standard Terminology of Fire Standards; Nov. 11, 2014; 20 pages.
Auburn Manufacturing Company; Auburn Product News—R-10400M; Dec. 2007; 1 page.
AWCI Construction Dimensions; Where's the Beef in Joint Sealants? Hybrids Hold the Key by Lester Hensley; Jan. 2006 3 pages.
British Board of Agrement; Compriband 600 Sealing Tapes—Certificate 96/3309; Jul. 14, 2005; 8 pages.
British Board of Agrement; Compriband Super-Certificate 97/3331; Aug. 2, 2005; 4 pages.
British Board of Agrement; Illmod 600 Sealing Tapes; Mar. 26, 2003; 8 pages.
British Standards Institute; Translation—NEN 6069; Oct. 1991; 31 pages.
British Standards Institution; Fire tests on building materials and structures (BS476:Part 20); 1987; 44 pages.
Building and Engineering Standards Committee; Impregnated cellular plastics strips for sealing external joints—DIN 18542; Jan. 1999; 10 pages.
BuildingTalk; Choosing a sealant for building applications by Lester Hensley CEO and President of Emseal; May 21, 2007; 6 pages.
Centre for Fire Research; Determination of the Fire Resistance According to NEN 6069 of Joints in a Wall Sealed with Cocoband 6069 Impregnated Foam Strip; Nov. 1996; 19 pages.
DIN ev; Fire behavior of building materials and building components; Sep. 1977; 11 pages.
DIN ev; Fire behavior of building materials and building components; May 1998; 33 pages.
DIN ev; Fire behavior of building materials and elements; Mar. 1994; 144 pages.
Dow Corning; Dow Corning 790 Silicone Building Sealant; 1999; 8 pages.
Dow Corning; Dow Corning 790 Silicone Building Sealant; 2000; 6 pages.
Dow Corning; Dow Corning 790 Silicone Building Sealant; 2004; 4 pages.
Dow Coming; Dow Corning Firestop 400 Silicone Sealant; Jan. 15, 2001; 4 pages.
Dow Coming; Dow Corning Firestop 700 Silicone Sealant; Jan. 15, 2001; 6 pages.
Emseal Joint Systems Ltd.; Horizontal Colorseal Aug. 2000 2 pages.
Emseal Joint Systems Ltd.; Colorseal PC/SA Stick; 1 page; Jun. 7, 1995.
Emseal Joint Systems Ltd.; SJS-100-CHT-RN; 1 page; Nov. 20, 2007.
Emseal Joint Systems Ltd; 20H System Tech Data; Jun. 1997; 2 pages.
Emseal Joint Systems Ltd; Colorseal Aug. 2000 2 pages.
Emseal Joint Systems Ltd; DSH System; Nov. 2005; 2 pages.
Emseal Joint Systems Ltd; Fire-Rating of Emseal 20H System; Author of "LH"; Feb. 17, 1993/Apr. 18, 1993; 2 pages.
Emseal Joint Systems Ltd; Horizontal Colorseal Tech Data; Jun. 1997; 2 pages.
Emseal Joint Systems Ltd; Preformed Sealants and Expansion Joint Systems; May 2002; 4 pages.
Emseal Joint Systems Ltd; Preformed Sealants and Expansion Joints.; Jan. 2002; 4 pages.
Emseal Joint Systems Ltd; Seismic Colorseal; Apr. 1998; 2 pages.
Emseal Joint Systems; Seismic Colorseal; Aug. 2000; 2 pages.
Emseal; Benchmarks of Performance for High Movement Acrylic-Impregnated Precompressed Foam Sealants; Aug. 21, 2007; 7 pages (as captured by Archive.org).
Emseal; Seismic Colorseal-DS (Double Sided); Apr. 12, 2007; 4 pages.
Envirograf; Fire Kills; 2004; 8 pages available by at least Nov. 10, 2006 per Archive.org.
Fire Retardants Inc.; Fire Barrier CP 25WB + Caulk; 2002; 4 pages.
IBMB; Test 3002/2719—Blocostop F120; Mar. 24, 2000; 14 pages.
IBMB; Test 3263/5362—Firestop N; Jul. 18, 2002; 13 pages.
IBMB; Test 3568/2560; Sep. 30; 2005; 14 pages.
IFT Rosenheim; Evidence of Performance—Test Report 105 32469/1e U R1; Apr. 19, 2006; 8 pages.
Illbruck Bau-Produkte GmbH u Co. KG; Willseal Firestop; Sep. 30, 1995; 2 pages.
Illbruck Inc.; Will-Seal 250 Spec Data; Aug. 1989; 2 pages.
Illbruck International; willseal the joint sealing tape; Jan. 1991; 19 pages.
Illbruck Sealant Systems inc..; Illbruck Willseal 600; Sep. 2001; 2 pages.
Illbruck USA; MSDS—Willseal 150/250 and/or EPS; Jul. 21, 1986; 2 pages.
Illbruck/USA; Will-Seal 150 Spec Data; Nov. 1987; 2 pages.
Iso Chemie GmbH; Iso-Bloco 600; 2 pages; Jul. 1, 2006.
Specified Technologies, Inc.; Product Data Sheet PEN200 Silicone Foam; 2003; 2 pages; publication location unknown.
Specified Technologies, Inc.; Product Data Sheet SpecSeal Series ES Elastomeric Sealant; 2004; 4 pages; publication location unknown.
Specified Technologies, Inc.; Product Data Sheet SpecSeal Series ES Elastomeric Sealant; 2000; 4 pages; publication location unknown.
Specified Technologies, Inc.; Product Data Sheet PEN300 Silicone Foam; 2004; 4 pages; publication location unknown.
Specified Technologies, Inc.; Firestop Submittal Package; 2000; 37 pages; publication location unknown.
Dow Corning 890-SL Self-Leveling Silicone Joint Sealant, 2005, 4 pages, USA.
Emseal BEJS System—Bridge Expansion Joint System, May 26, 2010, 5 pages, Emseal Joint Systems, Ltd., retrieved on Mar. 30,

(56) References Cited

OTHER PUBLICATIONS 2016 from https://web.archive.org/web/20100526081854/http://www.emseal.com/products/infrastructure/BridgeJointSeals/BEJSBridgeJointSystem.htm.
Emseal Acrylic Log Home Tape Installation Instructions, Jun. 2011, 1 page, Emseal Joint Systems, Ltd., retrieved on Mar. 30, 2016 from https://web.archive.org/web/20160330181621/http://www.emseal.com/Products/Specialty/LogHome/AcrylicLogHome__Tapes__Install__X.pdf.
Horizontal Colorseal Tech Data, Jun. 1997, 2 pages, Emseal Joint Systems, Ltd.
20H System Data Sheet, Sep. 1996.
20H System Tech Data, Jun. 1997, 2 pages, Emseal Joint Systems, Ltd., USA.
BEJS System, Mar. 2009, 2 pages, Emseal Joint Systems, Ltd., USA.
Emseal's new Universal-90 expansion joints, Buildingtalk, Mar. 27, 2009, 2 pages, Pro-Talk Ltd.
Emseal Emshield DFR2 System DFR3 System Tech Data, May 2010, 4 pages, Emseal Joint Systems, Ltd., USA.
Seismic Colorseal by Emseal, Aug. 21, 2007, 4 pages, Emseal Corporation, USA.
Universal 90's, Aug. 4, 2009, 4 pages, Emseal Joint Systems, Ltd., USA.
Backerseal (Greyflex), Sep. 2001, 2 pages, Emseal Joint Systems, Ltd., USA.
Install Data—Horizontal Colorseal—with Epoxy Adhesive, Jun. 1997, 2 pages, Emseal Joint Systems, Ltd., USA.
Shane Thomas, International Search Report (PCT/US17/17132), dated May 4, 2017, 2 pages, United States Patent & Trademark Office as Searching Authority, Alexandria, Virginia, USA.
Shane Thomas, Written Opinion of the International Searching Authority (PCT/US17/17132), May 4, 2017, 4 pages, United States Patent & Trademark Office as Searching Authority, Alexandria, Virginia, USA.
PCT Recordation of Search History (PCT/US17/17132), Undated, 4 pages, United States Patent & Trademark Office as Searching Authority, Alexandria, Virginia, USA.

* cited by examiner

EXPANSION JOINT SEAL FOR SURFACE CONTACT APPLICATIONS

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to systems for creating a durable seal between adjacent horizontal panels, including those which may be subject to temperature expansion and contraction or mechanical shear. More particularly, the present disclosure is directed to an expansion joint design for use in surfaces exposed to foot or vehicular traffic.

Description of the Related Art

Construction panels come in many different sizes and shapes and may be used for various purposes, including roadways, sideways, and pre-cast structures, particularly buildings. Historically, these have been formed in place. Use of precast concrete panels for floors, however, has become more prevalent. Whether formed in place or by use of precast panels, designs generally require forming a lateral gap or joint between adjacent panels to allow for independent movement, such in response to ambient temperature variations within standard operating ranges, building settling or shrinkage and seismic activity. Moreover, these joints are subject to damage over time. Most damage is from vandalism, wear, environmental factors and when the joint movement is greater, the seal may become inflexible, fragile or experience cohesive and/or adhesive failure. As a result, "long lasting" in the industry refers to a joint likely to be usable for a period greater than the typical lifespan of five (5) years. Various seals have been created in the field. Moreover, where in a horizontal surface exposed to wear, such as a roadway or walkway, it is often desirable to ensure that contaminants are retarded from contacting the seal and that the joint does not present a tripping hazard, whether as a result of a joint seal system which extends above the adjacent substrates or as a result of positioning the joint seal system below the surface of the substrates. This may be particularly difficult to address as the size of the expansion joint increases.

Various seal systems and configurations have been developed for imposition between these panels to provide seals or expansion joints to provide one or more of fire protection, waterproofing, sound and air insulation. This typically is accomplished with a seal created by imposition of multiple constituents in the joint, such as silicone application, backer bars, and compressible foams.

Expansion joint seal system designs for situations requiring the support of transfer loads have often required the use of rigid extruded rubber or polymer glands. These systems lack the resiliency and seismic movement required in expansion joints. These systems have been further limited in functioning as a fire resistant barrier, which is often a desired function.

Other systems have incorporated cover plates that span the joint itself, often anchored to the concrete or attached to the expansion joint material and which are expensive to supply and install. These systems sometimes require potentially undesirable mechanical attachment, which requires drilling into the deck or joint substrate. Cover plate systems that are not mechanically attached rely on support or attachment to the expansion joint, thereby subjecting the expansion joint seal system to continuous compression, expansion and tension on the bond line when force is applied to the cover plate, which shortens the life of the joint seal system. Some of these systems use foam to provide sealing. But these foam systems can take on a compression set when the joint seal system is repeatedly exposed to lateral forces from a single direction, such as a roadway. This becomes more pronounced as these foam systems utilize a single or continuous spine along the length of the expansion joint seal system—which propagates any deflection along the length. The problems and limitations of the current foam sealing cover plate systems that rely on a continuous spline are well known in the art.

These cover plate systems are designed to address lateral movement—the expansion and compression of adjacent panels. Unfortunately, these do no properly address vertical shifts—where the substrates become misaligned when the end of one shifts vertically relative to the other. In such situations, the components attached to the cover plate are likewise rotated in space causing a pedestrian or vehicular hazard. The current systems do not adequately address the differences in the coefficient of linear expansion between the cover plate and the substrate or allow for curved joint designs. The inability of the current art to compensate for the lateral or thermal movement of the cover plate results in failure of attachment to the cover plate or additional pressure being imposed on one half of the expansion joint system and potentially pulling the expansion joint system away from the lower substrate.

SUMMARY

The present disclosure therefore meets the above needs and overcomes one or more deficiencies in the prior art by providing an expansion joint seal design which incorporates a plurality of ribs, a flexible member connecting the cover plate and the ribs, and may incorporate a load transfer plate to provide support to the rib from below, and/or foams of differing compressibilities, and therefore performs dynamically in response to changes. In particular, the present disclosure provides an alternative to the load transfer of an extruded gland or anchored cover plate, and does so without the movement limitations of extruded glands, and without the potential compression set, delamination or de-bonding found in these and foam expansion joints.

The disclosure provides an expansion joint seal system preferably comprising a cover plate, a plurality of ribs, a body of a resilient compressible foam sealant, wherein each of the ribs pierces the body of a resilient compressible foam sealant from the foam's top surface but does not extend to the foam's bottom surface, and having a flexible member connecting the cover plate to each of the ribs, wherein each of the plurality of ribs remains moveable in relation to the cover plate.

The disclosure provides an expansion joint seal system preferably comprising a cover plate, a plurality of ribs, a body of a resilient compressible foam sealant, wherein each of the ribs pierces the body of a resilient compressible foam sealant from the foam's top surface but does not extend to the foam's bottom surface, having a flexible member attached to the cover plate and to each of the ribs, wherein each of the plurality of ribs remains rotatable in relation to the cover plate, and having a force transfer plate to maintain the ribs in position with support from below.

The disclosure provides an expansion joint seal system preferably comprising a cover plate, a plurality of ribs, a body of a resilient compressible foam sealant, wherein each of the ribs pierces the body of a resilient compressible foam sealant from the foam's top surface but does not extend to the foam's bottom surface, having a flexible member attached to the cover plate and to each of the ribs, wherein each of the plurality of ribs remains rotatable in relation to the cover plate, and a second body of foam having a density different from the foam.

The disclosure provides an expansion joint seal system preferably comprising a cover plate, a plurality of ribs, a body of a resilient compressible foam sealant, wherein each of the ribs pierces the body of a resilient compressible foam sealant from the foam's top surface but does not extend to the foam's bottom surface, having a flexible member attached to the cover plate and to each of the ribs, wherein each of the plurality of ribs remains rotatable in relation to the cover plate, and the cover plate allows for linear thermal expansion, resistance to shock from impact.

The disclosure also provides an expansion joint seal system preferably comprising a body of a resilient compressible foam sealant which is strengthened by an internal compression spring, which may include a cover plate, a plurality of ribs, wherein the internal compression spring provides restorative and ongoing expansion force to maintain the seal of the body of a resilient compressible foam sealant.

The disclosure provides an expansion joint seal system preferably comprising a cover plate, at least one rib, wherein each of the ribs pierces the body of a resilient compressible foam sealant from the foam's top surface but does not extend to the foam's bottom surface, a body of a resilient compressible foam sealant which is strengthened by an internal compression spring.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

Figure 1:
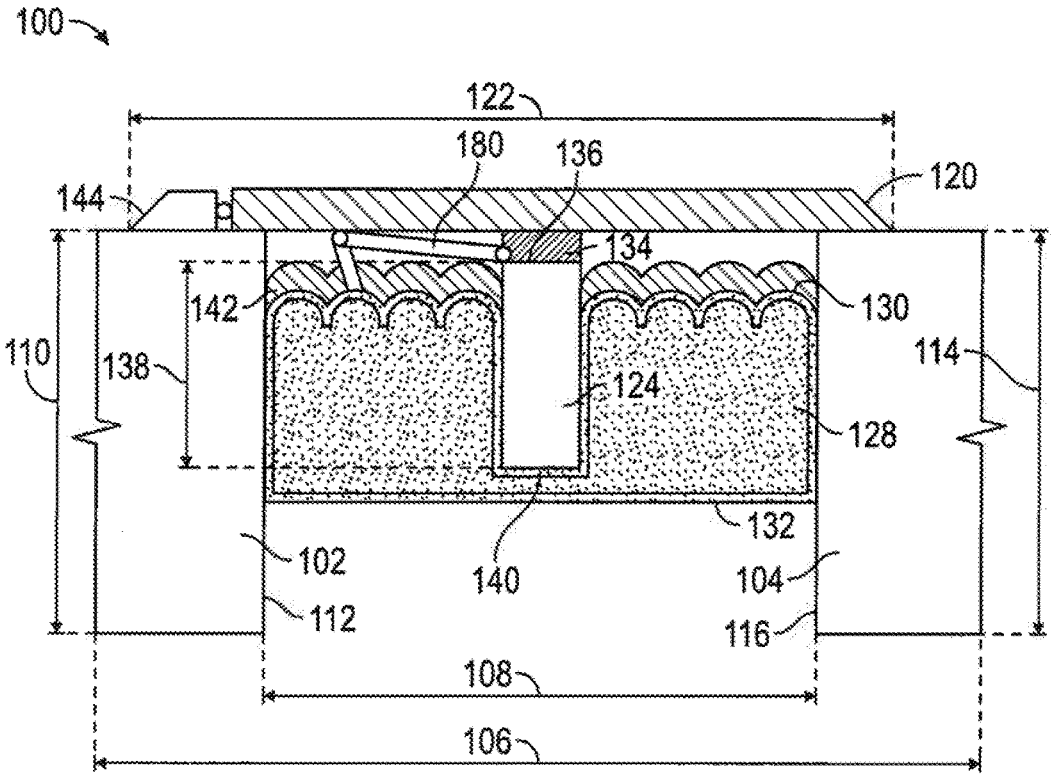
FIG. 1 provides an end view of one embodiment of the present disclosure.

An expansion joint seal system 100 is provided for imposition in a joint, such that a portion remains above the joint, i.e. partial imposition. The joint is formed of a first substrate 102 and a second substrate 104, which are each substantially co-planar with a first plane 106. The joint is formed as the first substrate 102 is separated, or distant, the second substrate 104 by a first distance 108. The first substrate 102 has a first substrate thickness 110, and has a first substrate end face 112 substantially perpendicular to the first plane 106. Likewise, the second substrate 104 has a second substrate thickness 114, and has a second substrate end face 116 substantially perpendicular to the first plane 106.

Referring to FIG. 1, an end view of one embodiment of the expansion joint seal system 100 of the present disclosure installed in a horizontal joint is provided. The expansion joint seal system 100 preferably includes a cover plate, a plurality of ribs 124, a body of a resilient compressible foam sealant 128, and a flexible member 134 attached to the cover plate 120 and to each of the plurality of ribs 124.

Figure 2:
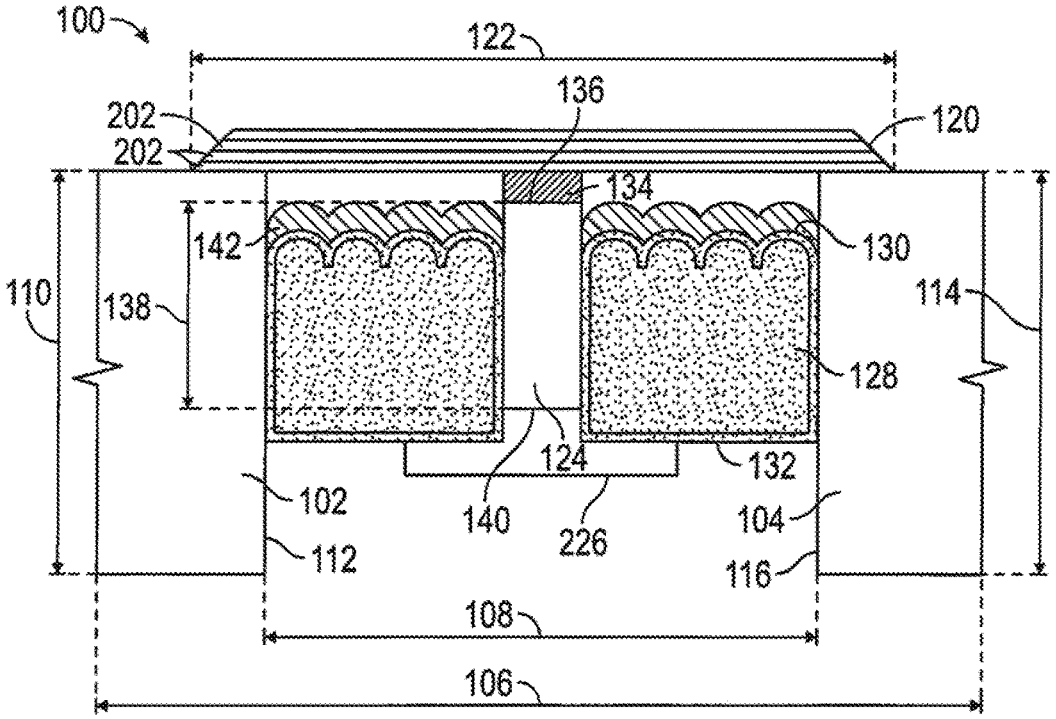
FIG. 2 provides an end view of an embodiment of the present disclosure.

The cover plate 120 is preferably made of a material sufficiently resilient to sustain and be generally undamaged by the surface traffic atop it for a period of at least five (5) years and of a material and thickness sufficient to transfer any loads to the substrates which it contacts. The cover plate 120 may be provided to present a solid, generally impermeable surface, or may be provided to present a permeable surface. The cover plate 120 has a cover plate width 122. To perform its function when positioned atop the expansion joint, and to provide a working surface, the cover plate width 122 typically is greater than the first distance 108. In some cases, it may be beneficial for a hinged ramp 144 to be attached to the edge of the cover plate 120. A ramp 144, hingedly attached to the cover plate 120 may provide a surface adjustment should the substrates 102, 104 become unequal in vertical position, such as if one substrate is lifted upward. A ramp 144 ensures that a usable surface is retained, even when the substrates 102, 104 cease to be co-planer, from the first substrate 102, to the cover plate 102, through to the second substrate 102. In the absence of such a ramp 144, movement of one substrate would result in the edge of the cover plate 102 being rotated upward—presenting a hazard to vehicular and pedestrian traffic. Alternatively, rather than being positioned atop the expansion joint, the cover plate 120 may be installed flush or below the top of substrate 102 and/or installed flush or below the surface of substrate 104. The contact point for cover plate 120 may be the deck or wall substrate or may be a polymer or elastomeric material to reduce wear and to facilitate the movement function of the cover plate 120. Regardless of the intended position, the cover plate 120 may be constructed without restriction as to its profile. The cover plate 120 may be constructed of a single plate as illustrated in FIG. 1. The cover plate 120 may be constructed of multiple cover plate layers 202, as illustrated in FIG. 2, enabling repair or replacements of wear surfaces without replacing the entire cover plate 120 or replacing the body of a resilient compressible foam sealant 128. Multiple layers 202 may be advantageous in environments wherein the cover plate will be subjected to strikes, such as by a snow plow or where the material of cover plate 120 may suffer from environmental exposure, such as in desert conditions. Each layer 202 is selected from a durable material which may be bonded or adhered to an adjacent layer 202, but which may be separated by the adjacent layer 202 upon the desired minimum lateral force. When desired, the cover plate 120 may be eliminated, together with attached components.

Figure 3A:
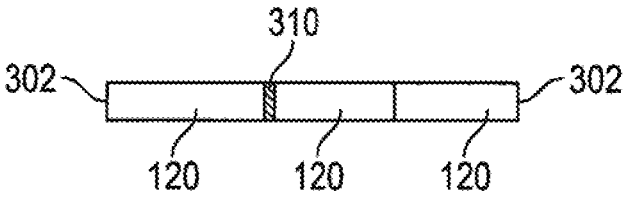
FIG. 3A provides a top view of one embodiment of the cover plate.
Figure 3B:
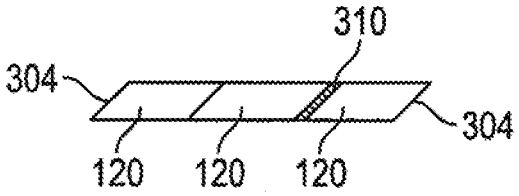
FIG. 3B provides a top view of another embodiment of the cover plate.
Figure 3C:
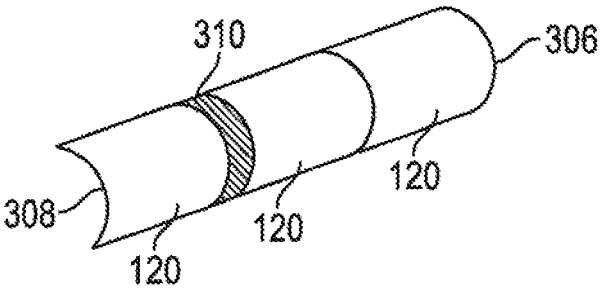
FIG. 3C provides a top view of a further embodiment of the cover plate.
Figure 3D:
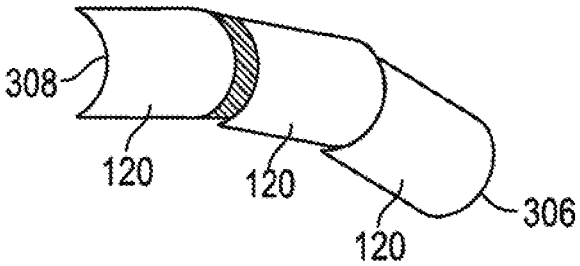
FIG. 3D provides a top view of an additional embodiment of the cover plate.
Figure 4:
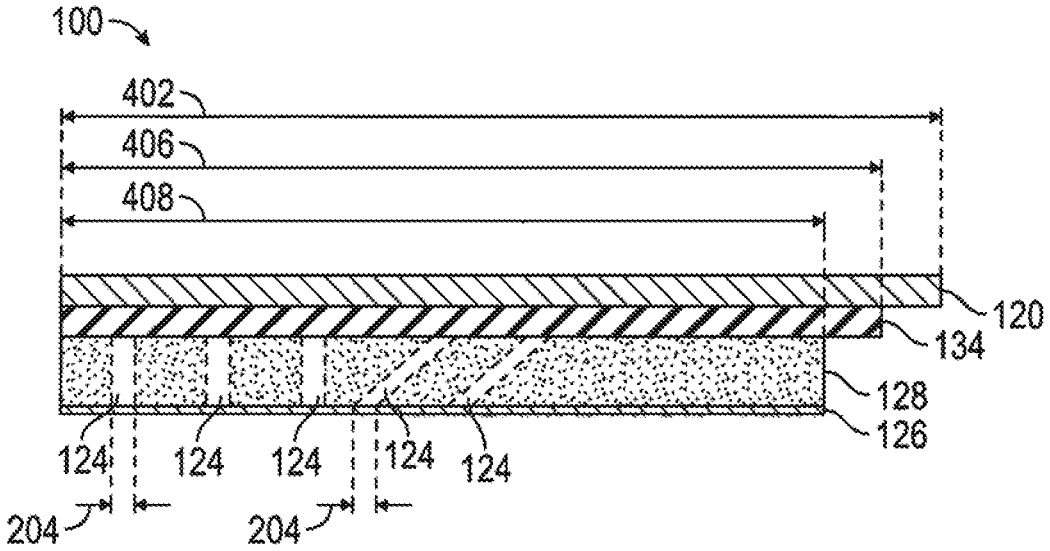
FIG. 4 provides a side view of one embodiment of the present disclosure.

As illustrated in FIGS. 3A, 3B, 3C and 3D, which provide top views of several embodiments of the cover plate 120, the cover plate 120 may use present a rectangular shape with a square end 302 as provided in FIG. 3A. The cover plate 120 may instead present an angled end 304 as provided in FIG. 3B. This angled end 304 may be at more than an angle of 90 degrees. The angled end 304 is beneficial where the cover plate 120 may expand in response to temperature variations. Rather than buckling upward like a conventional, square-ended cover plates 120, the angled end 304 causes the cover plate 120 to be rotated with respect to the joint. The rotation is impeded, and reversed after cooling, by the plurality of ribs 124 and body of a resilient compressible foam sealant 128. As provided in FIGS. 3C and 3D, the cover plate may present a first curved end 306 and a second complementary curved end 308, each with the same radius. The curved ends 306 and 308 thus abut at least in part over a range of respective angles, permitting use of a cover plate 120 without gapping along straight and curved joints. As the radius of the curved joint decreases, the cover plate length 402, as illustrated in FIG. 4, will be accordingly reduced to permit operation. Shorter cover plate lengths 402 may be used to provide segmented lengths to allow for less damage and curves during thermal expansion. Use of cover plates 120 with angled end 304 or curved ends 306 and 308 permits each cover plate 120 to move without opening a continuous gap in the direction of traffic.

Referring to FIG. 2, an end view of an embodiment of the expansion joint seal system 100 of the present disclosure installed in a horizontal joint is provided. The expansion joint seal system 100 may further include a force transfer plate 226 to which one or more of the ribs 124 may be flexibly and/or rotatably attached at the end opposing the flexible member 134. Some or all of the ribs 124 may be fixedly attached to the force transfer plate 226 or may be pivotally attached so as to permit one or two degrees of freedom. Where attached, the rib 124 may be detachably attached to the force transfer plate 226. The force transfer plate 226 has a force transfer plate length 406, which is equivalent in length to the cover plate length 402 and the force transfer plate length 406 being equivalent. The force transfer plate 226 need not be rigid or continuous and can be connected to ribs 124 in a fixed, hinged or multi-axis rotational connection. A flexible force transfer plate 226 permits the use of the expansion joint seal system 100 in joints which are not straight. The force transfer plate 226 may retard the movement of some or each rib 124, but also, by virtue of its connection to the body of a resilient compressible foam sealant 128, may provide support to the ribs 124 from below.

The force transfer plate 226 need not retard the movement of each rib 124 as the movement of each rib 124 will be retarded by the body of a resilient compressible foam sealant 128. Flexible attachment of the ribs to the cover plate 120 and to the force transfer plate 226 permits multi-axis movement of the ribs 124 and the flexible member 134 in connection with cover plate 120. The force transfer plate 226 may be composed, or contain, hydrophilic or fire-retardant or other compositions that would be obvious to one skilled in the art. In the event of a failure of the body of a resilient compressible foam sealant 128 to retard water or to inhibit water penetration, a hydrophilic or hydrophobic composition on the force transfer plate 226 may react to inhibit further inflow of water. Additionally, the force transfer plate 226 may contain or bear and intumescing agent, so that upon exposure to high heat, the force transfer plate 226 may react, and provide protection to the expansion joint. The force transfer plate 226 is maintained in position at least by attachment or contact with the body of a resilient compressible foam sealant 128. The force transfer plate 226 may be positioned so as to contact and be adhered only to the foam bottom surface 132 of the body of a resilient compressible foam sealant 128. Alternatively, the force transfer plate 226 may be positioned within the body of a resilient compressible foam sealant 128 so that the edges of the force transfer plate 226 may extend into the body of a resilient compressible foam sealant 128 and be supported from below by the body of a resilient compressible foam sealant 128. Preferably, the force transfer plate 226 is positioned within the lowest quarter of the body of a resilient compressible foam sealant 128 for maximum load force absorption. The force transfer plate 226 may be positioned higher in the body of a resilient compressible foam sealant 128 in lighter duty or pedestrian applications.

The force transfer plate 226 does not attach to either of the substrates 102, 104 and is maintained in position by connection to the body of a resilient compressible foam sealant 128. The force transfer plate 226 may provide support from below for the ribs 124 which are not otherwise supported from below by the body of a resilient compressible foam sealant 128. In high cover plate shear conditions, the force transfer plate 226 supports a joint system which is wider or which uses a narrow depth, and uses the resistance to compression to retard each of the ribs 124 from shifting and delivering all of the compressive force to the trailing edge side of the expansion joint seal system 100. This reduces the ultimate force and the amount of compression by applying the compressive force over a larger area and at a 90 degree angle to the direct compressive force which adds longevity to the useful life compared to the prior art.

Figure 7:
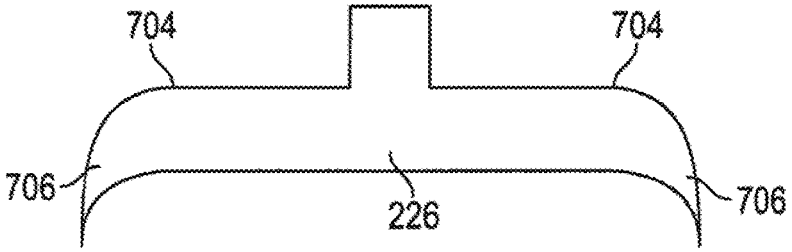
FIG. 7 provides an end view of one embodiment of the force transfer plate.

Preferably, the force transfer plate 226 is sufficiently wide to maximize load transfer. The force transfer plate 226 can be up to or greater than 50% of the width of the expansion joint in seismic applications requiring +/−50% movement. Referring to FIG. 7, the force transfer plate 226 may include downwardly curving hook-like appendages 706 at the lateral ends of the bottom of the force transfer plate 226 to aid in retarding downward movement of the joint system 100 in the joint and contact of the joint system 100 with the bottom of the joint. These may include pre-grooved break points 704 designed to fail in a seismic event, to avoid restricting the joint from closing and damaging the substrate. It can further be an advantage to use a light weight polymer or other material that will support the force transfer plate 226 horizontally and tend to return the ribs 124 back to center after traffic force is removed. When the cover plate 120 is omitted from an expansion joint system, the force transfer plate 226 would likewise be omitted.

As provided in FIGS. 3A, 3B, 3C, and 3D, a compressible spacer 310, which may be compressible or sliding material, may be provided at the end of a cover plate 120 or between adjacent cover plates 120. The compressible spacer 310 may be an elastomer which may be attached to the end of the cover plate 120. As a result, each cover plate 120 is insulated from the adjacent cover plate 120 and any forces applied to it. Beneficially, the cover plate 120 may therefore experience thermal expansion without damage to the plurality of ribs 124 or the body of a resilient compressible foam sealant 128. Additionally, use of an angular end 304 or curved end 306, 308 provides a surface with reduced potential to trip or catch.

Referring to FIG. 4, a side view of one embodiment of the present disclosure is provided. The cover plate 120 has cover plate length 402, which is at least as great as the length 406 of the flexible member 134. The body of a resilient compressible foam sealant 128 likewise has a length 408 which is less than the cover plate length 402. Preferably, the cover plate 120, the body of a resilient compressible foam sealant 128, and the force transfer plate 226 are equivalent in length. Because the ribs 124 need not have substantial length to perform, the sum of the rib length 404 of each of the ribs 124 may be less than one half the cover plate length 402, though the relationship may be altered by shorter or longer ribs 124. There is therefore an appreciable distance between each rib 124. The ribs 124 may be oriented in any direction from the flexible member 134. Typically, these will descend directly downward from the cover plate 120, but may be angled as desired along a longitudinal axis 210 of the cover plate 120. When the cover plate 120 is omitted from an expansion joint system, the ribs 124 would likewise be omitted.

Referring to FIGS. 1, 2, 5, 6 and 8, the flexible member 134 can be removable from the cover plate 120 at the underside of the cover plate 120 and may be flexible or rotatable. The point of attachment may be in the middle of the cover plate 120, but may be offset from the centerline of the cover plate 120. The flexible member 134 may be of any resilient structure which permits angular rotation of the ribs 124 known in the art. The flexible member 134 may be, for example, a hinge, or may be a short rigid member with a hinge at the end for attachment to the cover plate 120 and at the end for attachment to the rib 124, or may be a member with its own spring force, such as steel, or a high durometer rubber, or carbon fiber. The flexible member 134 may be a pivot joint retained at locations along the cover plate 120, such as a conventional hinge or a flexible connector. When the cover plate 120 is omitted from an expansion joint system 100, the flexible member 134 would likewise be omitted. When desired, the flexible member 120 may be omitted, and the cover plate 120 directly attached to the ribs 124.

Referring to FIGS. 1, 2, 4, 5, 6, 8, 9 and 10, the expansion joint system 100 is presented as imposed in a horizontal joint with the cover plate 100 in the same plane. The cover plate 100 however, need not be in the same plane as the body of a resilient compressible foam sealant 128. In some instances, such as in a stairway, it may be advantageous for the cover plate 120 to be in a vertical plane, while the body of a resilient compressible foam sealant 128 may be in the horizontal plane as depicted in FIGS. 1, 2, 4, 5, 6, 8, 9 and 10.

Figure 5:
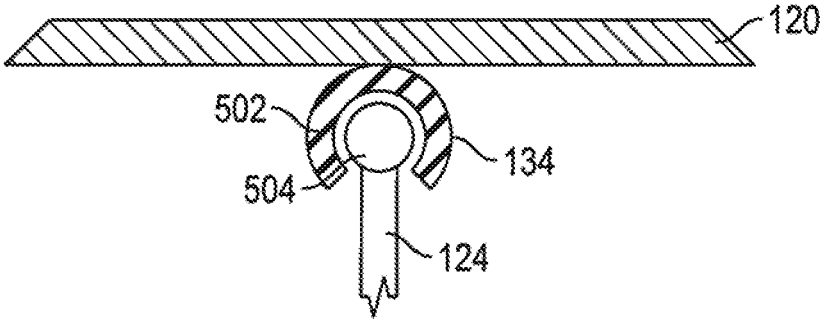
FIG. 5 provides an end view of a flexible member for an embodiment of the present disclosure.

Alternatively, as depicted in FIG. 5, the flexible member 134 may be constructed with an interlocked partial open cylinder, or first member 502, and an encircled cylindrical second member 504.

Figure 6:
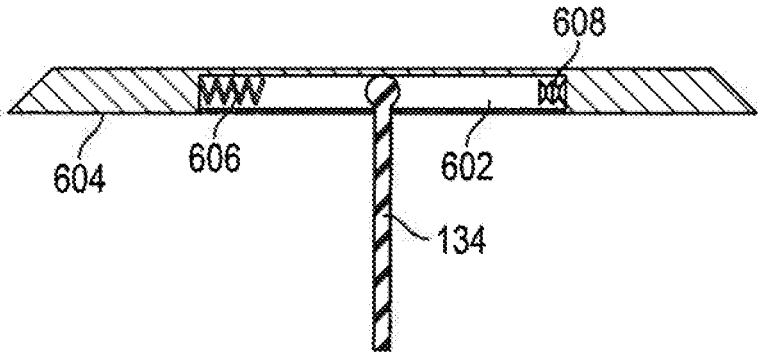
FIG. 6 provides an end view of an embodiment of the cover plate and flexible member.

Referring to FIG. 6, the flexible member 134 can be attached to the cover plate 120, via a closed elliptical slot 602 in the bottom 604 to allow for movement in the direction of impact, allow for access to the joint with the flexible member 134 attached to the cover plate 120. The slot 602 in the bottom 604 of the cover plate 120 may incorporate a force-dissipating device, such as a spring 606 or rubber shock absorption material 608, at an end of the closed elliptical slot 602 to reduce the force transferred from the cover plate and therefore to the foam seal. The damping force of the spring 606 or rubber shock absorption material 608, or the vertical position of the flexible member 134 with respect to the cover plate 120 may be adjusted using a set screw or other systems known in the art.

Figure 8:
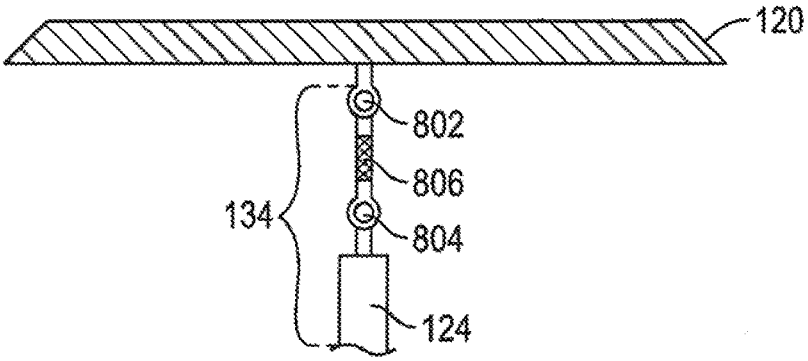
FIG. 8 provides an end view of a flexible member for an embodiment of the present disclosure.

Referring to FIG. 8, the flexible member 134 may comprise a first connector 802, a second connector 804, and connecting member 506. The connecting member 806 may be a rubber or flexible material that elongates under extreme force. Alternatively, the connecting member 806 may be flexible spring steel, which will flex or rotate, but not detach, from the cover plate 120. The first connector 802 may be a swivel connection, or other connection permitting some degree of freedom of motion, and the second connector 804 may likewise be a swivel connector, or other connection permitting some degree of freedom of motion, allowing for installation assistance, and preventing direct force from being transferred to the foam/core joint sealant. This structure of the flexible member 134 may assist in retaining the cover plate 120 in place, while preventing the cover plate 120 from becoming offset with respect to the joint. Additionally, this structure of the flexible member 134 reduces the force applied to the cover plate 120 from being transmitted entirely through to the body of a resilient compressible foam sealant 128, extending the lifespan of the body of a resilient compressible foam sealant 128 while reducing the direct force to the ribs 124 and the body of a resilient compressible foam sealant 128.

Referring to FIGS. 1, 2, 5, 6, and 8, the flexible member 134 is preferably detachable from the cover plate 120, such that the cover plate may be installed separately and may be removed for access and maintenance of the other components. Any system of attachment may be used, such as screws or bolts, as well as a keyed member to lock the cover plate 120 to the flexible member 134 when rotated one direction and to unlock the cover plate 120 from the flexible member 134 when rotated back to an original position. A keyed member reduces the potential for modification or vandalism as the tools for removal of the cover plate 120 are not readily available.

The cover plate 120 may be detachably attached to the flexible member 134. Expansion joint seals are often installed under conditions where mechanical strikes against the cover plate 120 are likely, such as roadways in locales which use snow plows. When used, snow plows employ a blade positioned at the roadway surface to scrape snow and ice from the roadway for removal. Any objects which extend above the roadway surface sufficient to contact the plow are likely to ripped from the roadway surface. It may therefore be preferable for the cover plate 120 to be detachably attached magnetically to the flexible member 134 and retained with a tether 180 to prevent the cover plate 120 from falling into the joint between the substrates 102, 104. This embodiment permits snow plow strikes on the cover plate 120 without permanent damage to the body of a resilient compressible foam sealant 128 or the balance of the expansion joint seal system 100. The tether 180, which may be also attached to the body of a resilient compressible foam sealant 128, may further prevent the body of a resilient compressible foam sealant 128 from sagging away from the cover plate 120, a problem known in the prior art. The tether 180 may be highly flexible, resilient material sufficient to sustain the impact load and sufficiently durable to do so the life of the joint system 100. The support of the foam seal is of particular (or increased) importance where the foam joint seal is in a width to depth ratio of less than 1:1. Alternatively, the cover plate 120 may be detachably attached to the flexible member 134 using screws, bolts or other devices prepared to break-away in the event of a strike. The flexible member 134 may also be constructed to break apart in the event of a strike. Where the flexible member 124 is provided as a hinge, the first member 302 of the flexible member 124 may be constructed of a high strength polymer, but which is still weaker than the associated second member 304.

Referring to FIGS. 1, 2, 5, 6, and 8, each of the plurality of ribs 124 are attached to the flexible member 134. Rather than providing a solid spline as in the prior art, the present disclosure provides a plurality of members, the ribs 124, which move independent of one another and about which each is surrounded by the body of a resilient compressible foam sealant 128, rather than being located on either side of a spline. Therefore, each of the plurality of ribs 124 remains rotatable in relation to the cover plate 120. The resilient compressible foam sealant 128 fills the distance between the ribs 124, tying each of the ribs 124 to the other ribs 124 and therefore to the cover plate 120. Each rib 124 has a rib top edge 136, a rib thickness 138, a rib bottom surface 140, and a rib length 404. The sum of the rib length 404 of each of the ribs 124 is not more than one half the plate length 402. Ribs 124 may be provided as cylindrical bodies or may provide a rectangular prism oriented along the longitudinal length of the system 100. There is therefore an appreciable distance between each rib 124. The rib thickness 138 is sufficiently less than both the first substrate thickness 110 and the second substrate thickness 114, that neither any rib 124 nor body of a resilient compressible foam sealant 128 contacts the bottom of the expansion joint. Beneficially, each rib 124 moves within the body of a resilient compressible foam sealant 128 and therefore absorb any force transmitted from the cover plate 120 and permit access to the body of a resilient compressible foam sealant 128 after installation, when needed. In rotation, each rib 124 transfers any rotational force introduced into the system 100 into the body of a resilient compressible foam sealant 128 which absorbs the force by its compressive recovery force.

Referring to FIGS. 1, 2, 3, and 4, to provide the seal against the faces 112, 116 of the first and second substrates, the expansion joint seal system 100 includes a body of a resilient compressible foam sealant 128. The body of a resilient compressible foam sealant 128 has a foam length 408, as provided in FIG. 4, a foam bottom surface 132, a foam top surface 130, and an uncompressed foam width. The uncompressed foam width of the body of a resilient compressible foam sealant 128 has a foam length 408 is greater than the first distance 108. As a result, when the body of a resilient compressible foam sealant 128 is imposed between the two substrates 102, 104, the body of a resilient compressible foam sealant 128 is maintained in compression between the two substrates 102, 104 and, by virtue of its nature, inhibits the transmission of water or other contaminants further into the expansion joint. The body of a resilient compressible foam sealant 128 contacts the first substrate end face 112 and the second substrate end face 116, when imposed under compression between the first substrate 102 and the second substrate 104. An adhesive may be applied to the substrate end face 112 and the second substrate end face 116 or to the body of a resilient compressible foam sealant 128 to ensure a bond between the expansion joint seal system 100 and the substrates 102, 104. Over time, as the first distance 108 between the first substrate 102 and the second substrate 104 changes, such as during heating and during cooling, the body of a resilient compressible foam sealant 128 expands to fill the void of the expansion joint, or is compressed to fill the void of the expansion joint. Preferably, the body of a resilient compressible foam sealant 128 is one body of foam, but may be a lamination of several layers. The body of a resilient compressible foam sealant 128 may be of polyurethane foam, and may be of an open celled foam, or a closed cell foam. When desired, a combination of open and closed cell foams may be used. The body of a resilient compressible foam sealant 128 may contain, hydrophilic, hydrophobic or fire-retardant compositions as impregnates, or as surface infusions, full or partial, or combinations of them. While the cell structure of body of a resilient compressible foam sealant 128 inhibits the flow of water, the presence of an inhibitant or a fire retardant may prove beneficial.

When desired, the compressibility of the body of a resilient compressible foam sealant 128 may be altered by forming the body of a resilient compressible foam sealant 128 from two foams of differing compressibility, providing a different spring force on the two sides of the ribs 124. Unequal densities, and thus spring forces, may provide a desirable spring force in the direction of movement of the traffic above, such as a roadway or one side of a concourse, to return the ribs 124 to the original position and to avoid the potential for a compression set over time due to the unequal application of movement to the expansion joint seal system 100. This may be accomplished by the foam in the body of a resilient compressible foam sealant 128 on one side of the ribs 124 having a first foam body density and the foam in the body of a resilient compressible foam sealant 128 on opposing side of the ribs 124 having a second foam body density. Alternatively, the foam in the body of a resilient compressible foam sealant 128 on one side of the ribs 124 may be homogenous, while the foam in the body of a resilient compressible foam sealant 128 on the opposing side of the ribs 124 may be a composite, such as a laminate of two foams. Having differing and complementary densities in the two bodies of a resilient compressible foam sealant 128 between the top and the bottom portions of the bodies of a resilient compressible foam sealant 128 on each side of the ribs 124 provides for lower resistance on one side to allow for quicker equalization or recovery of the opposing high density foam that is subject to repeated compressive force. This same combination works at the top and bottom of each rib 124 so that there is more resistance to compression set on the top high density portion due to the rotational force at the ribs 124 caused by the differing densities such that the high density foam on the bottom opposing side (the side of the ribs 124 which would normally extend not compress) compresses and absorbs or offsets some of the high compressive force. Because of the lower density foam on the opposing bottom side it allows better expansion recovery of the high density than if it was of equal density or compression.

While each of the ribs 124 pierces the body of a resilient compressible foam sealant 128 at the foam top surface 130, the rib bottom surface 140 does not extend to the foam bottom surface 132. As a result, the body of a resilient compressible foam sealant 128 is not pierced through by the ribs 124. The body of a resilient compressible foam sealant 128 thus provides support to each of the ribs 124 from below. Additionally, the body of a resilient compressible foam sealant 128 provides lateral forces against each side of each of the ribs 124, maintaining each rib 124 in position relative to the two substrates 102, 104. Beneficially, where the ribs 124 do not pierce the body of a resilient compressible foam sealant 128, the body of a resilient compressible foam sealant 128 remains integral such that a portion of the body of a resilient compressible foam sealant 128 provides a seal against outside contaminates in the expansion joint, to seal and support the bottom of the rib 124, the rib bottom surface 140. The present disclosure thus provides a seal against contaminants following a rib 124 through the seal, and allows for extra wide joint systems without the added expense depth requirements of systems without a bottom support. Some or all of the ribs 124 may be electrically conductive or be composed, or contain, hydrophilic or fire-retardant compositions. Some or all of the ribs 124 may further include a radio frequency identification device to transmit internal data when needed or may include cathodic protections. In the event of a failure of the body of a resilient compressible foam sealant 128 to retard water or to inhibit water penetration, a hydrophilic or hydrophobic composition on the rib 124 may react to inhibit further inflow of water. Additionally, each rib 124 may contain or bear an intumescing agent, so that upon exposure to high heat, the rib 124 may react, and provide protection to the expansion joint.

As provided in FIG. 4, each rib 124 need not descend directly downwardly from the cover plate 120. Ribs 124 may be angled laterally or longitudinally.

Referring to FIGS. 1, 2, 3A, 3B, 3C, and 3D, the expansion joint seal system 100 may be positioned in expansion joints that are not linear, such as those incorporating a curve or turn, such as a right-angle turn. Previous expansion joint seal systems, which incorporated a solid spine or spline, were incapable of this use, which is made possible by the use of flexible member 134 connecting the ribs 124 and the cover plate 120. The spaced-apart ribs permit fitting the expansion joint seal system 100 into the joint without breaking the support mechanism, as would occur with a fixed spline. Because the flexible member 134 permits the ribs 124 to be positioned between the substrates 102, 104 without reference to differences in the top of each substrate and the orientation of the cover plate 120, and because the ribs 124 are maintained laterally and from below by the body of a resilient compressible foam sealant 128, the operation of the expansion joint seal system 100 is maintained regardless of the vertical relationship of the two substrates 102, 104. This allows for proper movement when the deck comprising the two substrates 102, 104 is subject to vertical shear or deflection between decks.

Moreover, the expansion joint seal system 100 may be initially installed such that the ribs 124 are angled against the intended flow of traffic when the body of a resilient compressible foam sealant 128 is composed of three or more foam members, such that a foam at the top of the body of a resilient compressible foam sealant 128 which is to be in compression due to traffic is of a higher density foam and that the opposing side, lower edge is likewise of a higher density foam. Because the relative force of the body of a resilient compressible foam sealant 128 determines the position of the ribs 124, equal densities maintain the body of resilient compressible foam sealant 128 in an intermediate position, one which limits operation to a maximum of 50% of the joint width for compression. Varied foam densities in the body of a resilient compressible foam sealant 128 on the two sides of the ribs 124, provides an additional 10-20% more compressive resistance to traffic impact. This improvement may be particularly beneficial in situations such as the down ramp in a parking garage where traffic attempts to decelerate while traveling over the joint cover 120, as this repeated circumstance will wear out an a joint based on evenly compressed and evenly offsetting force foam joints.

The ribs 124 need not be uniformly positioned. The ribs 124 may be positioned in staggered relationship such that no more than one half of the body of resilient compressible foam sealant 128 can be subject to compression. The balance of the body of resilient compressible foam sealant 128 resists the compression outside direct force of the ribs 124. The portion of the body of resilient compressible foam sealant 128 in compression may be further altered by angling the ribs 124 so as to subject less than half of the body of resilient compressible foam sealant 128 to direct compression. This allows the balance of the body of resilient compressible foam sealant 128 to be in a state of less compression and for the portion of the body of resilient compressible foam sealant 128 have a less compression to run longitudinally along the joint such that at any one point in the length of the joint the body of resilient compressible foam sealant 128 is in lower compression contact with the ribs 124, reducing compression set and creating a mechanical locking relationship between the resilient compressible foam sealant 128 and the ribs 124. These ribs 124 may be attached to the force transfer plate 226. Moreover, by directing the various ribs 124 at differing angles within the 124, the ribs 124 may entangle the body of resilient compressible foam sealant 128 so as to make it integral with the ribs 124 and, by extension, to the cover plate.

Figure 9:
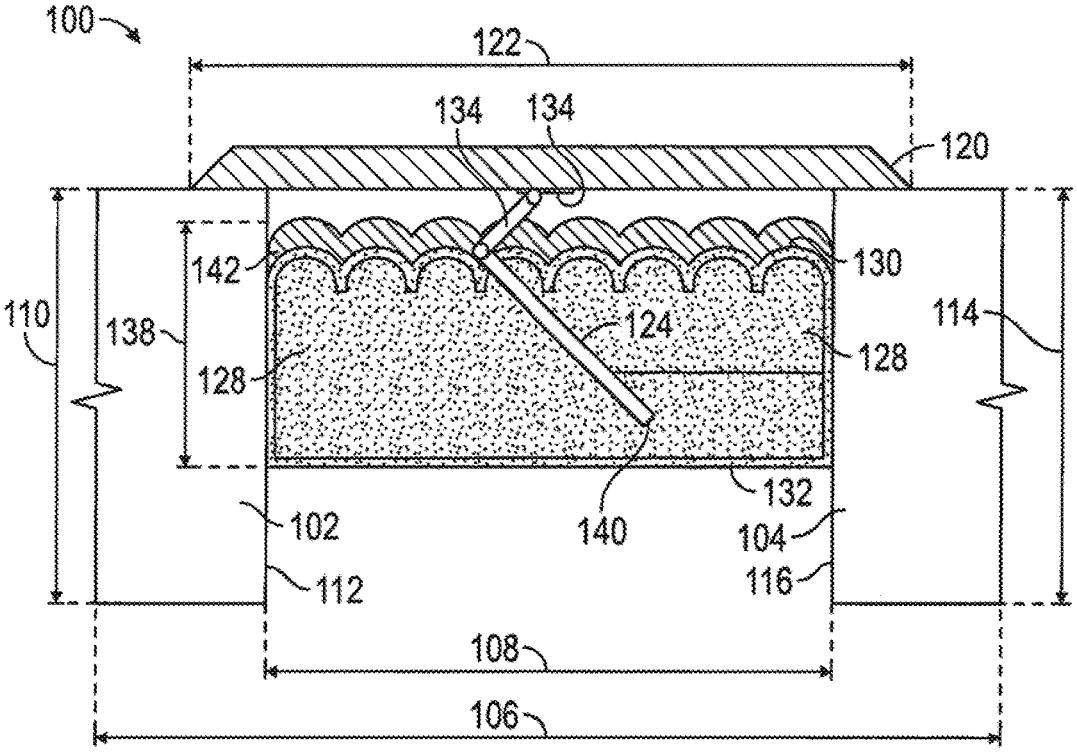
FIG. 9 provides an end view of an embodiment of the present disclosure.

Referring to FIG. 9, an illustration of an embodiment incorporating several of the preceding components. The flexible member 134 depicted in FIG. 8 is provided, along with two bodies of a resilient compressible foam sealant 128, each having its own compression ratio, as well as an angled rib 124. The joint seal 100 provided in FIG. 9 maintains the sealing properties of each body of a resilient compressible foam sealant 128 and the protection of the joint cover 120, while providing the benefits of the flexible member 134, the rib 124, and the varied compression ratio of the bodies of a resilient compressible foam sealant 128, all of which serve to transfer loads from the cover plate 120 and to accommodate movement of all components.

Referring again to FIGS. 1 and 2, a coating 142 may be adhered to the body of a resilient compressible foam sealant 128 on its top surface 130. The coating 142 may be an elastomer or a low modulus sealant, preferably vapor permeable to allow for moisture escape and thus reducing the potential of freezing of the expansion joint seal system 100. The elastomer may be, for example, silicone, urethane or a membrane.

Figure 10:
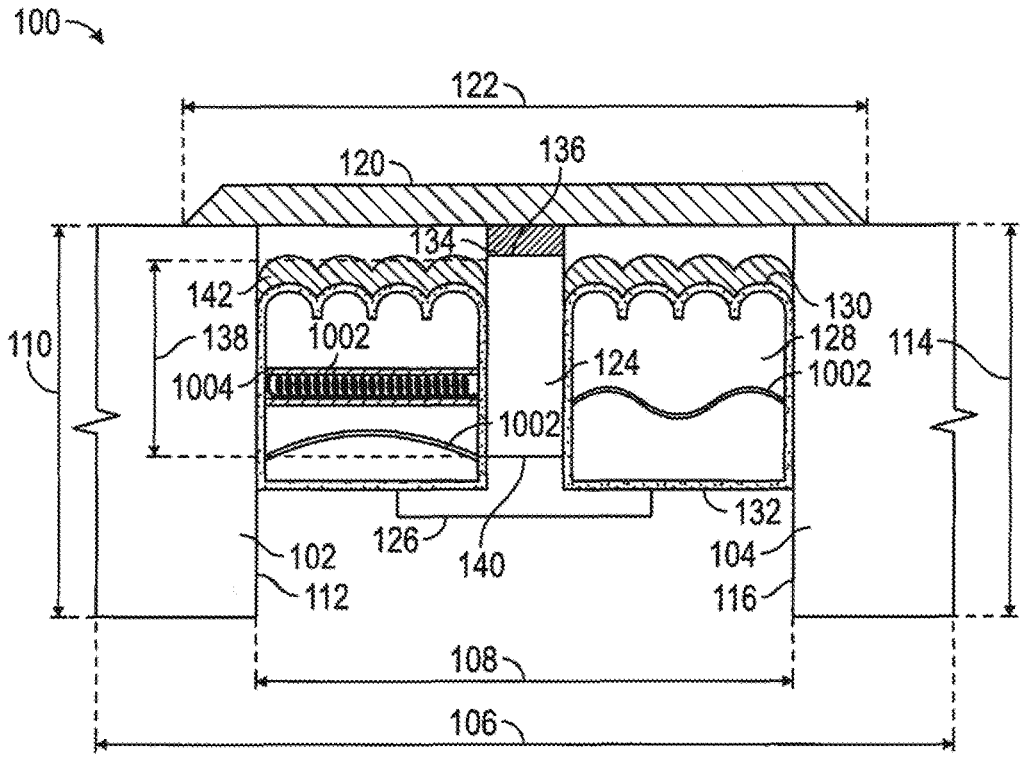
FIG. 10 provides an end view of an embodiment of the present disclosure incorporating a shock absorbing system.

Referring to FIG. 10, an embodiment of the present disclosure incorporating a shock absorbing system is provided. To further absorb the impacts transferred from the cover plate 120 to the body of a resilient compressible foam sealant 128 by the ribs 124, the expansion joint seal system 100 may include a shock absorption system including a compression spring 1002, connected to one or more of the ribs 124 and extending laterally into the body of a resilient compressible foam sealant 128 or connected to the flexible member 134 and extending laterally to the end face 112, 116 of one or both of the adjacent substrates 102, 104. As illustrated in FIG. 10, the compression spring 1002 may extend fully through the body of a resilient compressible foam sealant 128, or may alternatively stop short, so as not to contact a substrate 102, 104. The compression spring 1002 may be positioned at any point on the rib 124 and may be selected from any spring known in the art, including a helical compression spring, a cylindrical compression spring, a plate spring, and may be a linear rate spring providing a constant rate, a progressive rate spring providing a variable rate, or a multiple rate spring, such as one providing a firm rate and a soft rate. Where the compression spring 1002 is a plate spring, it may be provided as an arc or with a sinusoidal pattern. Where a coiled compression spring 1002 is utilized, the compression spring 1002 may be screwed into the body of a resilient compressible foam sealant 128 or may be encapsulated within a cylindrical housing 1004. The compression spring 1002 may be a single member extended across the ensure system 100, or may be positioned on only one side of the rib 124. Regardless of the structure selected, the compression spring 1002 increases the resistance to compression of the body of a resilient compressible foam sealant 128, buffers the ribs 124 against abrupt impact or shock, and reduces the likelihood of compression set in the body of a resilient compressible foam sealant 128, while the body of a resilient compressible foam sealant 128 provides damping force. The compression spring 1002 may include an end piece, which may be resistant to corrosion or which possesses less potential to damage the face 112, 116 of the adjacent substrate 102, 104. The end piece may be provided as any shape desired, such as a rubber cylinder in contact with the face 112, 116 of the adjacent substrate 102, 104 or may be presented as a larger member, such as a flange, which is captured within the body of a resilient compressible foam sealant 128 and therefore never contacts the face 112, 116 of the adjacent substrate 102, 104.

Figure 11:
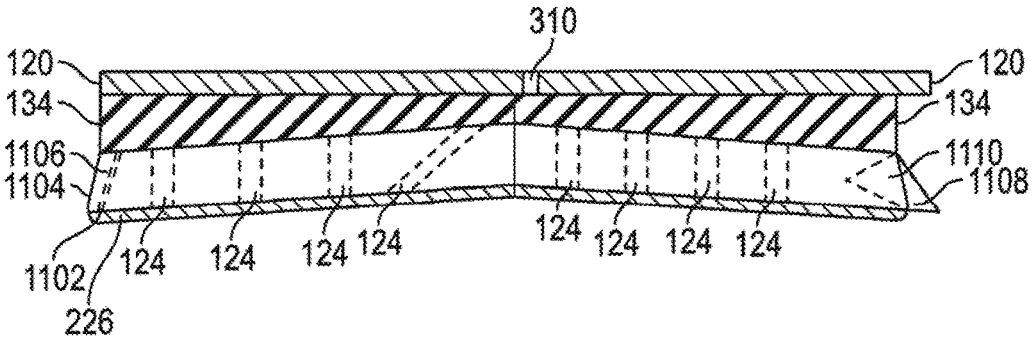
FIG. 11 provides a side view of an embodiment of the present disclosure facilitating shedding of liquid.

Referring to FIG. 11, a side view of an embodiment of the present disclosure facilitating shedding of liquid is provided. Because the flexible member 134 is attached to the cover plate 120 and to each of the plurality of ribs 124, the flexible member 134 may be a plurality of connectors of increasing height as depicted in FIG. 11, such as a plurality of separate second members 504 of FIG. 5, or a plurality of the first connectors 802, connecting members 806, and second connectors 804, or of consistent height as depicted in FIG. 4. Flexible member 134, whether provided as a single piece or as a plurality of connectors, may be provided so as increase per unit distance, so that the body of a resilient compressible foam sealant 128 and associated ribs 124 are skewed with respect to the cover plate 120, and thereby provide an incline to facilitate shedding of liquid within the joint between the substrates 102, 104 and above the body of a resilient compressible foam sealant 128. As illustrated in FIG. 11, when the system 100 is provided within a joint transitioning from a horizontal joint to a vertical joint, the system 100 may be provided to shed liquid out to the vertical edge, including by a drain 1102 through the body of a resilient compressible foam sealant 128, or by a drip edge 1104 which may be facilitated by an extending end 1106. The extending end 1106 may be provided as a portion of into the body of a resilient compressible foam sealant 128 or may be provided as a separate component 1108 with an piercing end 1110 which may be driven into the body of a resilient compressible foam sealant 128. To provide the system 100 in an rectangular prism shape, the body of a resilient compressible foam sealant 128 may be tapered to present the thinner end at the drain 1102, the drip edge 1104, the extending end 1106 or the component 1108. The top of the body of a resilient compressible foam sealant 128 may be provided with a sculpted top to direct liquid to one or both substrates 102, 104, or top a channel intermediate the two in the top of the body of a resilient compressible foam sealant 128.

The system 100 may be supplied in individual components or may be supplied in a constructed state so that it may installed in an economical one step operation yet perform like more complicated multipart systems. The entire system 100 may be constructed such that a gap is present between the cover plate 120 and the resilient compressible foam sealant 128 and a retaining band positioned about the resilient compressible foam sealant 128 to maintain compression during shipping and before installation without additional spacers that would limit test fitting of the system 100 prior to releasing the resilient compressible foam sealant 128 from factory compression. Packaging materials, that increase the bulk and weight of the product for shipping and handling to and at the point of installation, are therefore also eliminated.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal for partial imposition in a joint having a first substrate and a second substrate, the first substrate and the second substrate being substantially coplanar with a first plane, the first substrate being distant the second substrate by a first distance, the first substrate having a first substrate thickness and a first substrate end face substantially perpendicular to the first plane, the second substrate having a second substrate thickness and a second substrate end face substantially perpendicular to the first plane comprising:

a cover plate having a cover plate length, a plurality of ribs, each of the plurality of ribs having a rib top edge, a rib thickness, a rib bottom surface, each rib top edge having a rib length, a body of a resilient compressible foam sealant having a foam length, a foam bottom surface, a foam top surface, and an uncompressed foam width, the uncompressed foam width being greater than the first distance, each of the plurality of ribs piercing the body of a resilient compressible foam sealant at the foam top surface, the rib not extending to the foam bottom surface, a flexible member attached to the cover plate and to each of the plurality of ribs, wherein each of the plurality of ribs remains rotatable in relation to the cover plate, the cover plate length and the foam length being equivalent;

the sum of the rib lengths of the plurality of ribs being not more than one half the plate length, and the body of a resilient compressible foam contacting the first substrate end face when imposed under compression between the first substrate and the second substrate, the body of a resilient compressible foam contacting the second substrate end face when imposed under compression between the first substrate and the second substrate.

2. The expansion joint seal of claim 1, further comprising a force transfer plate having a force transfer plate length, the force transfer plate being fixedly attached to some of the plurality of ribs, the force transfer plate providing upward support to some of the plurality of ribs, the force transfer plate maintained in position by connection to the body of a resilient compressible foam sealant, and the cover plate length and the force transfer plate length being equivalent.

3. The expansion joint seal of claim 2, further comprising a second body of a resilient compressible foam sealant, the second body of a resilient compressible foam sealant having a second foam body density;

wherein the body of a resilient compressible foam sealant has a foam body density, the foam body density being unequal to the second foam body density;

the second body of resilient compressible foam adjacent the body of a resilient compressible foam sealant.

4. The expansion joint seal of claim 1 further comprising:

an elastomeric coating adhered to the body of a resilient compressible foam sealant at the foam top surface.

5. The expansion joint seal of claim 1, further comprising:

an impregnation, the impregnation impregnated into the body of a resilient compressible foam, the impregnation selecting from at least one of a fire retardant and a water inhibitor.

6. The expansion joint seal of claim 2, further comprising:

an impregnation, the impregnation impregnated into the body of a resilient compressible foam, the impregnation selecting from at least one of a fire retardant and a water inhibitor.

7. The expansion joint seal of claim 1, wherein at least one of the plurality of ribs being non-parallel to at least another one of the plurality of ribs.

8. The expansion joint seal of claim 1, further comprising at least one of the plurality of ribs being non-perpendicular to the first plane.

9. The expansion joint seal of claim 1, wherein the flexible member includes a first hinged connector, a second hinged connector and a connecting member intermediate the first hinged connector and the second hinged connector.

10. The expansion joint seal of claim 1, further comprising:

a tether attached to the body of a resilient compressible foam sealant and to the cover plate.

11. The expansion joint seal of claim 1, wherein the cover plate is constructed of multiple cover plate layers.

12. The expansion joint seal of claim 2, further comprising:

a compressible spacer at an end of the cover plate.

13. The expansion joint seal of claim 1, wherein the flexible member comprises a cylindrical second member and a partial open cylinder first member, the partial open cylinder first member interlocking about and partially encircling the cylindrical second member.

14. The expansion joint seal of claim 1, wherein the cover plate further includes a cover plate width, the cover plate width being greater than the first distance.

15. The expansion joint seal of claim 1, wherein the cover plate includes a closed elliptical slot in a cover plate bottom and wherein the flexible member is attached to the cover plate at the closed elliptical slot.

16. The expansion joint seal of claim 15, further comprising a force-dissipating device and an end of the closed elliptical slot.

17. The expansion joint seal of claim 2, wherein the force transfer plate includes at least one pointed downwardly depending extension from a bottom of the force transfer plate.

18. The expansion joint seal of claim 1 further comprising a compression spring, the compression spring connected to at least one of the plurality of ribs and extending laterally into the body of a resilient compressible foam sealant.

19. The expansion joint seal of claim 2 further comprising a compression spring, the compression spring connected to at least one of the plurality of ribs and extending laterally into the body of a resilient compressible foam sealant.

20. The expansion joint seal of claim 19 further comprising a cylindrical housing about the compression spring.

* * * * *